US005454207A

United States Patent [19]

Storandt

[11] Patent Number: 5,454,207

[45] Date of Patent: Oct. 3, 1995

[54] APPLICATOR MITT

[76] Inventor: Duane L. Storandt, 12 Hanley Downs, St. Louis, Mo. 63117

[21] Appl. No.: 113,797

[22] Filed: Aug. 30, 1993

Related U.S. Application Data

[63] Continuation-in-part of Ser. No. 705,918, May 28, 1991, Pat. No. 5,356,397, and Ser. No. 705,919, May 28, 1991, Pat. No. 5,301,490, which is a division of Ser. No. 212,503, Jun. 28, 1988, Pat. No. 5,019,058, which is a continuation-in-part of Ser. No. 9,053, Jan. 27, 1987, abandoned, which is a continuation of Ser. No. 681,921, Dec. 14, 1984, abandoned, which is a continuation of Ser. No. 316,654, Oct. 30, 1981, abandoned, said Ser. No. 705,918, is a continuation-in-part of Ser. No. 212,503.

[51] Int. Cl.[6] ..... B65B 61/00

[52] U.S. Cl. ..... 53/410; 53/450; 53/210

[58] Field of Search ..... 53/410, 450, 429; 493/493, 210, 223, 224

[56] References Cited

U.S. PATENT DOCUMENTS

| | | | |
|---|---|---|---|
| 2,603,790 | 7/1952 | Boehm-Myro | 2/158 X |
| 2,921,731 | 1/1960 | Volckening et al. | 229/76 |
| 2,969,144 | 1/1961 | Zackheim | 602/57 |
| 2,998,880 | 9/1961 | Ladd | 206/363 |
| 3,004,698 | 10/1961 | Ashton | 229/625 |
| 3,291,376 | 12/1966 | Goodwin | 229/62.5 |
| 3,338,019 | 8/1967 | Trewella | 53/450 |
| 3,608,566 | 9/1971 | Storandt | 132/84 |
| 3,608,705 | 9/1971 | Moshel | 206/45.31 |
| 3,608,708 | 9/1971 | Storandt | 206/46 R |
| 3,647,485 | 3/1972 | Seiferth et al. | 99/174 X |
| 3,675,264 | 7/1972 | Storandt | 132/84 |
| 3,870,150 | 3/1975 | Hummel | 206/438 X |
| 3,880,159 | 4/1975 | Diamond | 602/58 |
| 3,952,867 | 4/1976 | McCord | 401/7 |
| 3,995,739 | 12/1976 | Tasch et al. | 206/484 |
| 4,015,306 | 4/1977 | Fenster | 15/209 R |
| 4,181,069 | 1/1980 | Porter | 93/35 R |
| 4,211,330 | 7/1980 | Strock | 206/581 |
| 4,256,256 | 3/1981 | Meyers | 53/450 |
| 4,347,931 | 9/1982 | Ginger et al. | 206/438 |
| 4,557,377 | 12/1985 | Maloney | 53/450 |
| 4,641,643 | 2/1987 | Greer | 602/57 |
| 4,646,731 | 3/1987 | Brower | 602/57 |
| 4,797,967 | 1/1989 | Lengers | 15/227 |
| 4,928,680 | 5/1990 | Sandbank | 602/57 |
| 5,018,516 | 5/1991 | Gilman | 602/57 |
| 5,019,058 | 5/1991 | Storandt | 604/289 |
| 5,065,863 | 11/1991 | Moyet-Ortiz | 206/210 |
| 5,088,483 | 2/1992 | Heinecke | 602/57 |
| 5,099,832 | 3/1992 | Ward | 602/57 |
| 5,127,127 | 7/1992 | Jarosinski | 15/227 |

*Primary Examiner*—Jack W. Lavinder
*Attorney, Agent, or Firm*—Cohn, Powell & Hind

[57] ABSTRACT

This applicator mitt includes an inner pouch and an outer pouch providing a cover for the inner pouch. The inner pouch includes an outer face receiving a treating substance and is formed from a pair of panels, attached on two sides and one end and having separable margins on the other end to receive the hand portion of the user. The outer pouch can be a simple envelope or can be formed from a pair of panels attached to each other and to the inner pouch, said panels being removable to expose the inner pouch treating substance but remaining attached to the inner pouch during use.

11 Claims, 7 Drawing Sheets

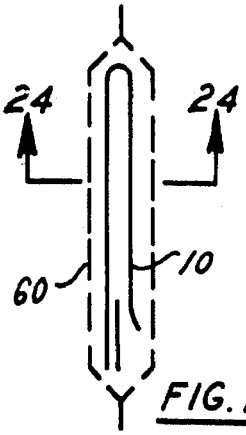
FIG. 19.
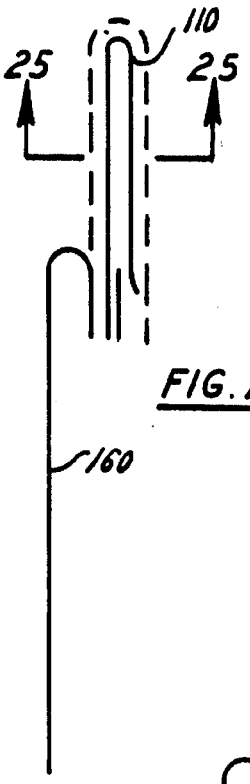
FIG. 20.
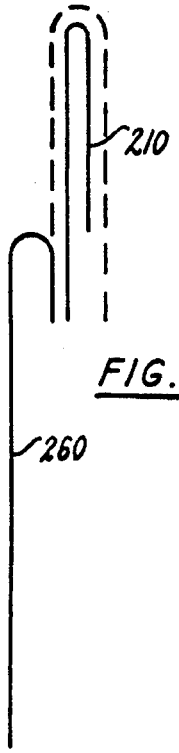
FIG. 21.
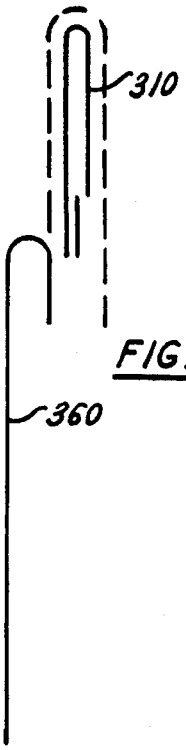
FIG. 22.
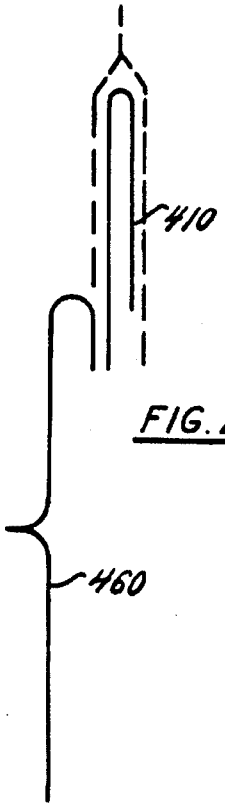
FIG. 23.
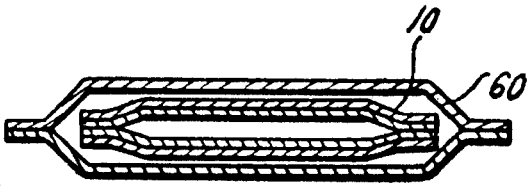
FIG. 24.
FIG. 25.
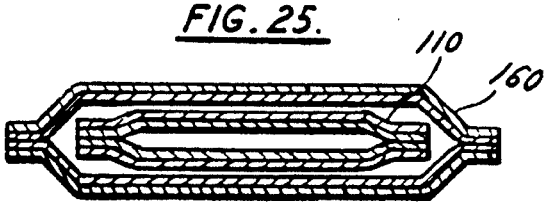

1100
1102
1103
1104
1105
1110
1112
1114
1116
1120
1122
1130
1132
910
960
968
970
971
980
985
990
924
926
928
932
934
941
982
984
28

APPLICATOR MITT

This appln is a CIP of Ser. No. 07/705,918 May 28, 1991 U.S. Pat. No. 5,356,397 which is a CIP of Ser. No. 07/212, 503 Jun. 28, 1988 U.S. Pat. No. 5,019,058.

This appln is a CIP of Ser. No. 07/705,919 May 28, 1991 U.S. Pat. No. 5,301,490 which is a DIV of Ser. No. 07/212, 503 Jun. 28, 1988 U.S. Pat. No. 5,019,058 which is a CIP of Ser. No. 07/009,053 Jan. 27, 1987 ABAN which is a CON of Ser. No. 06/681,921 Dec. 14, 1984 ABAN which is a CON of Ser. No. 06/316,654 Oct. 30, 1981 ABAN.

BACKGROUND AND SUMMARY OF THE INVENTION

This invention relates generally to an applicator device and more particularly to a device in the nature of a treated mitt receiving a portion of the hand and having a protective cover removable to expose the treated portion of the mitt during use.

Applicator devices of the general type under consideration are used for applying medicament to various body portions and can be used, for example, for applying dentifrice to the teeth of the user or ointment to injured parts of the user. They can also be used for the hand applicator of other treating substances, such as shoe polish, when it is desirable that such substances not come into contact with the skin of the user.

Applicators of this type provide that the treating substance is not exposed until ready for use and for this reason a combination package is provided in which an inner portion of the package, contains the treating substance on its outer face, and the inner portion is protected by an outer portion of the package, which can be removed so that the inner portion can receive the hand portion of the user and so that the treating substance can be exposed.

In particular, the applicator mitt which forms the subject matter of this invention represents an improvement over U.S. Pat. No. 3,608,566, U.S. Pat. No. 3,608,708, U.S. Pat. No. 3,675,264 and U.S. Pat. No. 5,019,058 issued to the present inventor. The first of these patents discloses an applicator mitt having an inner pouch and an outer cover, which is opened by means of a tear strip to expose the inner pouch; the second patent discloses an applicator mitt formed from continuous inner and outer webs; the third patent discloses an applicator mitt adapted to protect additional hand portions during use; and the fourth patent discloses an improved means of attaching the inner pouch to the outer pouch and the outer pouch portions to each other.

With applicator mitts of the above type heat and pressure sealing the inner and outer cover component parts represents a preferred method of construction. However, the particular structural arrangement of the component parts of such devices with the exception of that disclosed in U.S. Pat. No. 5,019,058 and the Copending applications Ser. Nos. 705,918 and 705,919 have not been such as to facilitate this kind of manufacture on a mass production basis.

The present applicator device solves these and other problems in a manner not revealed in the known prior art and represents a further improvement over U.S. Pat. No. 5,019, 058 and the related copending applications.

Thus, in a first aspect, there is provided an applicator mitt, preferably with a protective pouch, formed from a single sheet of material, the material being a laminate of a heat sealable substance and a substance suitable for use as the applicator portion, the sheet being longer in one direction and being folded in that direction such that the sides of the sheet are folded onto each other substantially in register and are heat sealed along at least part of the length in which they are in register, at least a finger tip being insertable between the seals.

The material may comprise a laminate of any suitable substances. The heat sealable layer is suitably a thermoplastic, such as EVA, and may be as thick or thin as required. In general, it is preferred that the heat seal be in the nature of a weld, so that the mitt retains its integrity in use.

It may also be desired not to seal completely along the edges so that it is easier to hold the edges apart for insertion of the relevant part of the hand. Thus, a flap could be left. It may also be desirable to leave an extended length of material extending as one of the folds, so as to protect any portions of the hand not in the mitt.

Thus, the invention also provides a mitt wherein the folded ends are not in register.

It will be appreciated that the mitts of the invention may be used for any purpose for which mitts are usually used, and may be any appropriate size. For example, they may only cover the finger tip, or may cover the whole hand. The required size will be readily apparent to one skilled in the art.

There is also provided a mitt having a non-weldable surface, preferably formed from a strip of laminate material heat sealable on one face, extending for the majority of the distance across the strip, at or near the opening, on the heat sealable side. Such an embodiment will generally provide that the opening of the mitt does not become sealed shut, so that the preferred position is between the terminus of the shorter end and the inner face of the longer end.

The term 'non-weldable' is used to indicate a surface which is not subject to change, such as melting, at the temperatures used to effect the heat sealing. Thus, it may be a plastic, for example, such as polyester or polytertrafluoroethylene, the only requirement being that, in itself, it is not subject to heat sealing, although it is advantageous if other substances can be sealed to the non-weldable surface, especially as a peel seal.

However, where there is provided a pouch as described below, the non-weldable surface may be provided on the longer end away from the shorter end. In such a case, this is generally to prevent adhesion of the pouch at or near the mouth of the mitt. It may also be useful to seal the pouch over the non-weldable surface to provide a peel seal.

The non-weldable surface may be provided in any suitable manner, and may comprise removing the heat sealable layer in the appropriate area, for example, or adding a further layer. The further layer may be a substance like talc which can be sprayed or dusted on when the heat sealable layer is hot, to secure it in place. In a particularly preferred embodiment, the layer is a laminate providing a layer of non-weldable substance, such as paper or foil, backed by a heat sealable layer. The layer can then be heat sealed to the mitt.

There is further provided a mitt having at least one internal heat seal to divide the interior of the mitt into separate portions, at least one, and preferably more portions, being suitable to receive at least a finger tip. This is preferred for larger mitts to give controlled handling of the mitt in use. The divisions may give the effect of a glove, or there may be just one, for example, to accommodate two finger tips.

It is preferred to provide a pouch. Accordingly the present invention also provides an applicator mitt having an external surface, at least part of which is adapted as the applicator portion, the mitt being packaged in a pouch comprising first and second panels secured together such as to enclose at least the applicator portion of the mitt, characterised in that the panels, in at least one section, are secured by peel-sealing, such that peeling of the section allows the exposure for use of the mitt.

Preferably, the pouch is formed from a folded strip of material or, alternatively, from two overlying sheets of material. In general, the seal will extend around the periphery of the panels to enclose the mitt. It will be appreciated that no seal is required at the fold.

The seals are preferably located at or near the edges of the pouch both to save material and avoid being able to pull them apart by catching the exposed edges. However, the invention also extends to the situation where, for whatever reason, the seal is inward of the edge.

In particular, it is preferred that at least the peel sealed section has exposed edges, so that the pouch can be pulled open by gripping the edges.

It is also preferred that, in contrast to the mitt, the seals are all peelable, so that the pouch can be opened completely out, if necessary.

Thus, it is preferred that the material forming the pouch is a laminate of a sealable substance and a wear-resistant substance, the sides of the panels being substantially in register and being sealed therealong, or adjacent thereto, to enclose the mitt as defined.

There is no particular limitation in the term 'wear-resistant', other than to require that the exterior of the pouch serves to protect the mitt in a desired manner, such as to prevent wear and tear, or simply to provide protection from the environment. Accordingly, a thin plastic film may be adequate to provide a hermetic seal, for example. In general, the wear-resistant layer serves to provide a base to support the heat sealable layer and to prevent the pouch from rupturing before it is required for use.

It is also preferred that the ends of the mitt are not in register, and the panels of the pouch are sealed, preferably peel sealed, across the longer end of the mitt. This provides a useful tab to assist in opening the pouch.

As described above, it is also preferred that the longer end of the mitt comprises a non-weldable surface across which the panels are peel sealed.

In a preferred embodiment, one of the panels is welded to the exterior face of the longer end of the mitt. This allows the panel or joined panels to provide a guard for the finger or hand, in use, or to give purchase.

There is also provided a method for the manufacture of a packaged mitt comprising placing the mitt on a strip of material sufficiently large to wrap around the mitt, the mitt comprising a laminate of a heat sealable material and a material suitable for use as an applicator, the mitt being in contact with the heat sealable material, and folding the strip over the mitt and heat sealing the resulting upper and lower surfaces of the strip around and away from the mitt. Alternatively, the method for manufacture can also comprise placing the mitt on a strip wider than the mitt and adding a second strip and sealing the resultant upper and lower surfaces of the strips around and away from the mitt.

In particular, it is preferred that the mitt is formed as a pair of mitts from a single strip of material as defined above, but wherein the two ends of the strip are folded in toward the centre of the strip to form the two mitts, the pair being placed on, and preferably welded to the wrapping material which is then folded in from both sides and both edges peel sealed, preferably leaving a tab, across the portion of material between the two mitts.

More preferred is where the mitt and/or wrapping material, preferably both, are formed from an elongate or continuous strip of material, the edge or edges being folded in to form the mitt or protective pouch, and transverse cutting of the strip or strips defining the width of the mitt and/or pouch.

Thus, in one aspect, the present invention relates to an applicator for dispensing dentifrice for example, the mitt being formed from a folded and heat sealed strip packaged in a protective folded and sealed strip, preferably with one of the folds of the mitt protruding through the seal of the protective pouch to form a tab for opening the package.

Other preferred aspects and embodiments are as follows. In one, there is provided a packaged applicator mitt formed from two laminated elongated sheets, the first laminated sheet including a first ply of a non-woven fabric layer, and, as a second ply bonded thereto, a thermoplastic film, the second laminated sheet being wider than the first sheet and including, as a first ply, a support layer capable of being printed on, and, as a second ply bonded thereto, a thermoplastic film, the first laminated sheet being folded with the fabric layer out and a portion of the sides thereof weld sealed to form an inner pouch, the wider second sheet being folded around the pouch so formed with the backing printable layer out, and the sides thereof peel sealed to form an outer pouch, the non-folded open end of the outer pouch being peel sealed forming inner pouch sealed-in within the outer pouch. Alternatively, in lieu of folding, the second sheet can be formed from upper and lower sheets heat sealed at the otherwise folded end.

Preferably, a separate seal is provided intermediate and parallel to the side margins to divide the inner pouch into more than one compartment.

Also, it is preferred that the open ends of the inner pouch are offset.

In another aspect, there is provided a packaged applicator mitt formed from two laminated elongated sheets, the first laminated sheet including a first ply of a non-woven fabric layer, and, as a second ply bonded thereto, a thermoplastic film, the second laminated sheet being wider than the first sheet and including, as a first ply, a support layer capable of being printed on, and, as a second ply bonded thereto, a thermoplastic film, the first laminated sheet being folded with the fabric layer out and a portion of the sides thereof weld sealed to form an inner pouch, the wider second sheet being folded around the pouch so formed with the backing printable layer out, and the sides thereof peel sealed to form an outer pouch, an end of one fold of the outer pouch being weld sealed to an end of one fold of the inner pouch, the outer pouch becoming a handle when unpeeled from outside the inner pouch.

One fold of the outer pouch is preferably transversely welded to the longer open end of the inner pouch, affording a handle when unpeeled from outside the inner pouch.

This applicator mitt provides a disposable package unit having an improved sealing system which can be manufactured using a combination of sealing techniques, on a mass production basis.

This invention includes an inner pouch having a pair of overlying upper and lower panels each having an outer face and a heat sealable inner face, opposed side margins and opposed proximal and remote end margins, said panels being formed from a folded sheet to provide a common remote end margin, said upper panel being shorter than said lower panel to provide spaced proximal end margins, said side margins being heat sealed together for at least a portion of the length thereof and the spaced end margin of the upper panel being substantially free of attachment to the lower panel to provide a hand portion-receiving entry opening into said pouch, and to provide an outer pouch receiving said inner pouch.

It is an aspect of this invention to provide a separator strip having an upper face and a lower face, said lower face being sealed to the inner face of the lower panel and said strip being disposed in underlying relation to said inner pouch upper panel.

It is an aspect of this invention to provide that the lower panel is substantially longer than the upper panel to provide a gripping means which can be held between the uninserted hand portion and the palm of the hand.

Yet another aspect of this invention is to provide a separate seal intermediate and parallel to the side margin seals to divide the inner pouch into more than one compartment.

Another aspect of this invention is to provide that the inner pouch upper and lower panels are formed from a laminated plastic sheet including a first ply of non-woven fabric providing said outer face, a second ply of plastic film providing said inner face and a third ply of extrusion coating sandwiched between said first and second plies.

It is an aspect of this invention to provide an outer pouch receiving said inner pouch, said outer pouch including a pair of overlying upper and lower panels, each panel having an outer face and a heat-sealable or cold sealable inner face, opposed side margins and opposed proximal and remote end margins, said side margins being heat sealed or cold sealed together for at least a portion of the length thereof and the inner face of the upper panel being operatively transversely heat sealed or cold sealed to the inner face of the lower panel of the inner pouch adjacent said proximal end margin and the inner face of the lower panel being operatively transversely weld sealed to the outer face of the lower panel of the inner pouch adjacent said proximal end margin.

Yet another aspect of this invention is to provide that the outer pouch transverse seal adjacent said proximal end margin is spaced from said proximal end margin of said upper panel to provide a liftable tab.

Another aspect of this invention is to provide a separator strip having an upper face and a lower face, said lower face being sealed to the inner face of the inner pouch lower panel and another aspect to provide a separator strip having said upper face sealed to the inner face of the outer pouch upper panel.

It is another aspect of this invention to provide that the outer pouch upper and lower panels are formed from a folded sheet to provide a common remote end margin.

Yet another aspect of this invention is to provide that the outer pouch upper and lower panels are formed from separate sheets sealed transversely at the remote ends thereof.

Still another aspect of this invention is to provide that the outer pouch upper and lower panels are formed from a laminated plastic sheet including a first ply of peel seal plastic film providing said inner face, a second ply of printable film providing said outer face and a third ply of support film sandwiched between said first and second plies.

Another aspect of this invention is to provide a method of constructing an applicator mitt comprising the steps of dispensing a web of material having first opposed margins defining opposed side portions, said web having a longitudinal axis disposed intermediate said margin; folding said side margins inwardly towards the longitudinal axis to define folded margins, the first margins being disposed in spaced relation from said folded margins and said longitudinal axis; cutting said folded web transversely at spaced intervals along the length thereof to form a plurality of individual sections having spaced transverse margins defining the width thereof; heat sealing said transverse margins for at least a portion of the length thereof to form a pair of open ended pouches; and slitting said individual sections along said longitudinal axis to form two separate pouches each having an upper panel and a lower panel said upper panel being shorter than said lower panel.

It is still another aspect of this invention to provide a method comprising the further steps of dispensing a relatively narrow web of material, having opposed margins disposed laterally inwardly of said longitudinal margins of said first web, and sealing said first and second webs together prior to folding so that the first web side portions overlap said second web following the folding process.

Yet another aspect of this invention is to provide a method comprising the further steps of dispensing a relatively wider web of material having first opposed margins defining opposed side margins, said web having a longitudinal axis disposed intermediate said margins; depositing said pair of open ended pouches onto said relatively wider web at spaced intervals; folding said side portions of said wider web inwardly towards said longitudinal axis to define folded margins, the first margins being disposed adjacent said longitudinal axis whereby said open ended pouch is sandwiched between said spaced end margins; sealing the open ended pouch, between said open ends to said sandwiching portions of said wider web; cutting said folded web transversely at spaced intervals along the length thereof greater than the width of said open-ended pouches; sealing said transverse margins for at least a portion of the length thereof to provide an outer pouch encapsulating said open ended pouches; and slitting said encapsulating pouch and said encapsulated pouches along said longitudinal axis to form two separate composite pouches.

Still another aspect of this invention is to provide a method including the further steps of dispensing a relatively wider web of material having first opposed margins defining opposed side margins, said web having a longitudinal axis disposed intermediate said margins; depositing said pair of open ended pouches onto said relatively wider web at spaced intervals; depositing a second relatively wider web of material having first opposed margins defining opposed side portions; said web having a longitudinal axis disposed intermediate said margins, onto said first web whereby said open-ended pouch is sandwiched between said spaced end margins; sealing said open-ended pouches between said open ends to said sandwiching portion of said wider web; cutting said overlying webs transversely at spaced intervals along the length thereof greater than the width of said open-ended pouches; sealing said transverse margins for at least a portion of the length thereof to provide an outer pouch encapsulating said open-ended pouches, and slitting said encapsulating pouch and said encapsulated pouches along said longitudinal axis to form two separate composite pouches.

It is a further aspect of this invention to provide a method of constructing a packaged applicator mitt, comprising the steps of forming a mitt from a folded laminate of heat sealable material and a material suitable for use as an applicator, the mitt having an open end, placing the mitt between first and second strips of sealable material sufficiently large to enclose the mitt, attaching the mitt substantially permanently to only one of said strips in the area of the open end, and sealing the strips together in spaced relation from the mitt to seal in the mitt and form an outer pouch so that the outer pouch can be opened adjacent the open end of the mitt and removed from the mitt with said mitt remaining attached to said one strip.

It is another aspect of this invention to provide a method of constructing a packaged applicator mitt in which said mitt is attached to said one strip by permanent adhesive.

It is still another aspect of this invention to provide a method of constructing a packaged applicator mitt in which said first and second strips each include plastic film having an inner coating of cold seal adhesive.

It is yet another aspect of this invention to provide a method of constructing a packaged applicator mitt in which said first and second strips are selectively coated with said cold seal adhesive to permit said mitt to be attached to said one strip in an area uncoated by said cold seal.

It is an aspect of this invention to provide a method of constructing a packaged applicator mitt in which said first strip is substantially completely coated with said cold seal adhesive and said second strip is pattern-coated with said cold seal adhesive to define an area uncoated by said cold seal receiving said mitt and permitting said mitt to be attached to said one strip.

It is still another aspect of this invention to provide method of constructing a packaged applicator mitt, comprising the steps of dispensing a web of material having first opposed margins defining opposed side portions, said web having a longitudinal axis disposed intermediate said margins, folding said side portions inwardly toward the longitudinal axis to define folded margins, sealing said web transversely at spaced intervals along the length thereof to form a plurality of pairs of open ended pouches, slitting said web longitudinally into opposed web portions, cutting said web portions transversely at spaced intervals along the length thereof to form a plurality of separated pairs of open-ended pouches disposed in side by side relation, dispensing first and second webs of material having first opposed margins defining opposed side portions, said web having a longitudinal axis disposed intermediate said margins, feeding said separated pairs of open-ended pouches between said first and second webs at spaced intervals whereby said open-ended pouches are sandwiched therebetween, sealing said open-ended pouches to one only of said sandwiching webs in substantially permanent relation, sealing said first and second webs together about said open-ended pouches to provide outer pouches encapsulating said open-ended pouches, slitting said encapsulating pouch along said longitudinal axis of said first and second webs, and cutting said first and second webs transversely at spaced intervals along the length thereof said open-ended pouches to form separate composite pouches.

It is still another aspect of this invention to provide a method of constructing a packaged applicator mitt in which said open-ended pouches are attached to said one web by permanent adhesive applied to said one web.

It is yet another aspect of this invention to provide a method of constructing a packaged applicator mitt in which said open-ended pouch transverse seals are substantially permanent heat seals.

It is another aspect of this invention to provide a method of constructing a packaged applicator mitt in which said first sandwiching web is substantially completely pre-coated with cold seal adhesive, and said second sandwiching web is pattern pre-coated with cold seal adhesive to define web areas uncoated by cold seal selectively receiving said open-ended pouches, said uncoated areas having a permanent adhesive applied to attach said open-ended pouch.

It is an aspect of this invention to provide a method of constructing a packaged applicator mitt in which said second sandwiching web patterned cold seal adhesive defines frame areas peel seal attachable to said cold seal adhesive of said first web cold seal adhesive.

It is still another aspect of this invention to provide a method of constructing a packaged applicator mitt in which said second sandwiching web patterned cold seal adhesive defines an uncoated area adjacent said open-pouch open end providing a tab for facilitating removal of said outer pouch.

It is an aspect of this invention to provide a packaged applicator mitt comprising a mitt formed from a folded laminate of heat sealable material and a material suitable for use as an applicator said mitt having an applicator end and an open end, first and second strips sandwiching said mitt and sufficiently large to enclose the mitt, adhesive means substantially permanently attaching said mitt to only one of said strips, and the sandwiching strips being sealed to each other in peel seal relation to expose the applicator end with said mitt remaining attached to said one strip.

Another aspect of this invention is to provide applicator mitts which are relatively inexpensive to manufacture by mass production methods, and which are easy to use by a consumer.

BRIEF DESCRIPTION OF THE DRAWINGS

The invention will now be further illustrated with reference to the accompanying drawings in which:

FIGS. 19–23 are simplified views showing the use of the single and composite pouches;

FIG. 24 is a sectional view taken on line 24—24 of FIG. 19,

FIG. 25 is a sectional view taken on lines 25—25 of FIGS. 20–23 prior to removal of the outer pouch.

Figure 3:
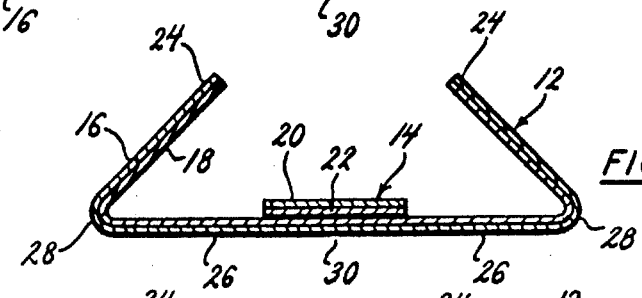
Figure 4:
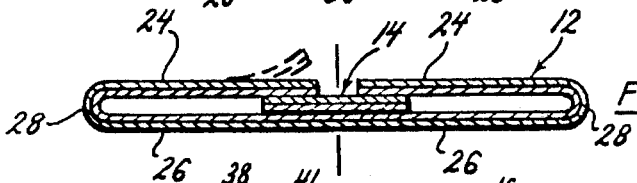
FIG. 4 is a cross sectional view showing the completion of a double inner pouch.
Figure 5:
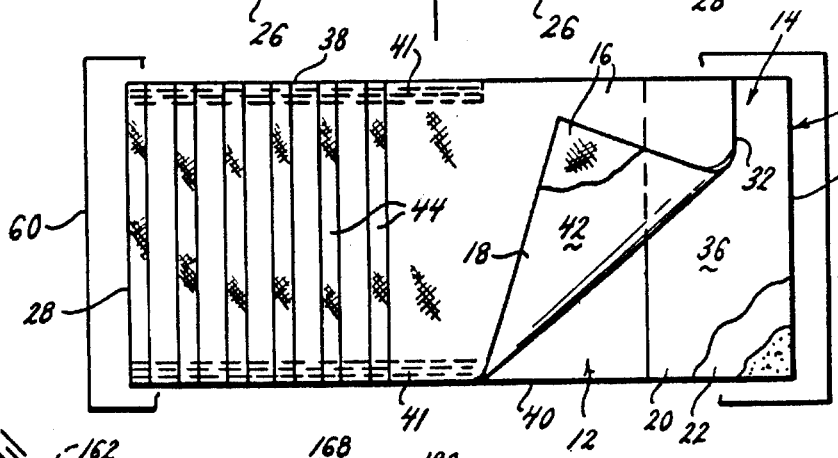
FIG. 5 is a plan view of a single inner pouch.

DESCRIPTION OF THE PREFERRED EMBODIMENTS:

Referring now by reference numerals to the drawings and first to FIGS. 1–5, it will be understood that FIGS. 1–4 disclose the steps in the construction of the inner pouch 10 shown in FIG. 5. In the embodiment shown, a pair of inner pouches 10 are formed from a relatively long two ply laminated plastic film or sheet 12 and a relatively short two ply laminated plastic film or sheet 14. The short sheet can be dispensed with if desired as will be discussed below.

The first ply 16 of the laminated sheet 12 is of non-woven fabric and the second ply 18 is of thermoplastic plastic film such as polyethylene or Ethyl Vinyl Acetate (EVA), which is heat sealable to itself and to other plastic film such as the non-woven fabric forming the first ply 16. The first ply 20 of the laminated sheet 14 is a support film of polyester, paper, foil or the like, which can be printed on, or otherwise decorated, and the second ply 22 is of thermoplastic plastic film such as polyethylene or EVA.

Figure 1:
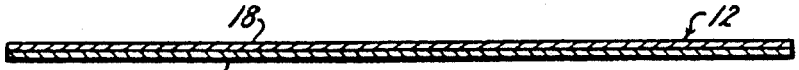
FIGS. 1–3 are cross sectional views showing progressive stages in the construction of the inner pouch shown in FIGS. 4 and 5.
Figure 2:
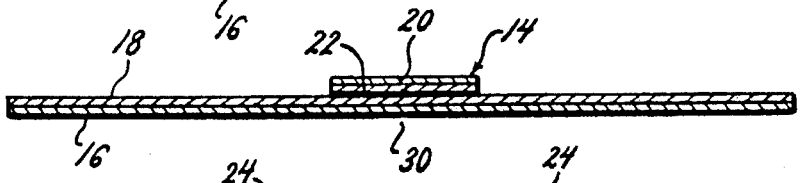

As shown in FIG. 2 sheet 14 is heat sealed to the sheet 12 substantially at the midpoint 30 thereof corresponding to the longitudinal axis of said webs used to form the inner pouch in the preferred embodiment. As shown in FIGS. 3 and 4 sheet 12 is folded to provide upper panels 24 and lower panels 26 defined by common remote end margins 28 and, when separated at the midpoint 30, to define spaced proximal margins 32 and 34 respectively, as shown in FIG. 5. In the embodiment shown, the upper panel 24 overlaps the attached half portion of sheet 14 which provides a separator sheet indicated by numeral 36. The opposed side margins 38 of the upper panel 24 and the opposed side margins 40 of the lower panel 26 are in register and are heat sealed together by weld seal 41 for the greater portion of the length indicated by numeral to provide a flap 42 at the end of the upper panel which affords easy access for a hand portion such as the index finger which is receivable into the entry opening of the pouch 10. In the preferred embodiment the outer face of the upper and lower panels, formed from non-woven material is coated or impregnated with strips of material 44 such as dentifrice so that the pouch provides an applicator mitt substitute for a toothbrush. The separator sheet 36 is not essential but provides a useful area for instructions or promotional material and also facilitates access to the pouch by inhibiting blocking. One or more of the pouches 10 may be contained within a sealed plastic envelope constituting an outer pouch indicated by numeral 60. This arrangement is shown schematically in FIG. 19. Alternatively, each inner pouch can be contained within its own individual outer pouch as will now be discussed with reference to FIGS. 6 and 7 in which similar parts are identified by the same numeral with the addition of a prefix "1".

Figure 6:
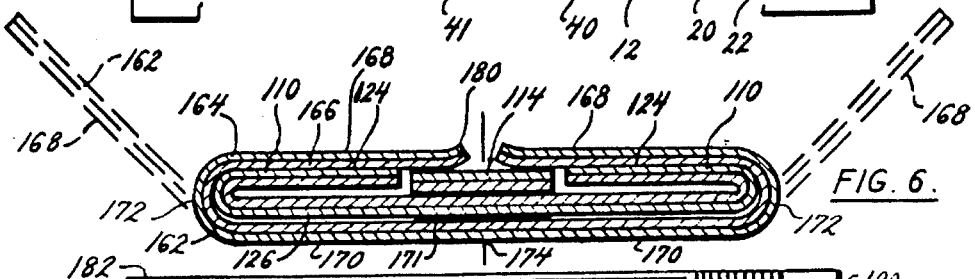
FIG. 6 is a cross sectional view showing a pair of composite inner and outer pouches.
Figure 7:
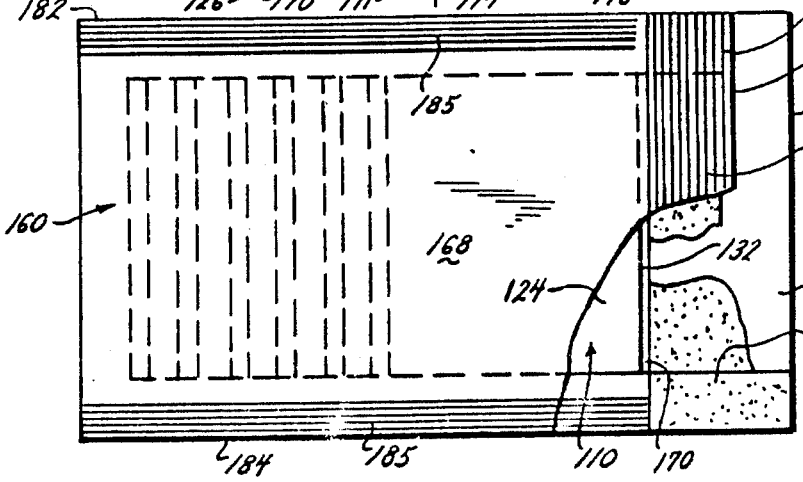
FIG. 7 is a plan view of one of the composite pouches of FIG. 6.

As shown in FIGS. 6 and 7 the inner pouch 110 is identical to the inner pouch 10 except that the upper panel **24*a* is shorter than upper panel 24 described above with the result that proximal end margin 132 is spaced from the separator sheet 136 and said upper panel normally does not overlap said separator sheet 136**.

The outer pouch 160 shown in FIG. 7 is one of a pair of outer pouches 160 formed from a relatively long two ply laminated plastic film or sheet 162. The first ply 164 of the laminated sheet 162 is of support film such as polyethylene, polyester, paper, foil, or the like, which can be printed on or otherwise decorated, and the second ply 166 is of thermoplastic film such as EVA which is heat and peel sealable to itself and to other film such as polyethylene, polyester, paper, foil and the like, forming the first ply 164.

As shown in FIG. 6 in phantom outline, sheet 162 is folded to provide upper panels 168 and lower panels 170 defined by common remote end margins 172 and, when separated at the midpoint 174, to define spaced proximal end margins 176 and 178 respectively. In the embodiment shown, the upper panel 168 overlaps the attached half portion of sheet 114 indicated by numeral 136 and is transversely heat sealed to said sheet 114 by peel seal 179. As clearly shown in FIG. 6 the seal is preferably stopped short of the upper panel proximal end margin so that a tab 180 is formed. The opposed side margins 182 of the upper panel 168 and the opposed side margins 184 of the lower panel 170 are in register and are heat sealed together by peel seals 185 so that the upper panel 168 can be peeled from the lower panel 170 is to expose the outer face of the inner pouch 110. In the embodiment shown the outer face of the inner pouch lower panel 126 is transversely heat sealed to the inner face of the outer pouch lower panel 170. This seal is preferably a weld seal 171 so that the inner pouch 110 remains attached to the outer pouch 160 as shown schematically in FIG. 20.

Figure 8:
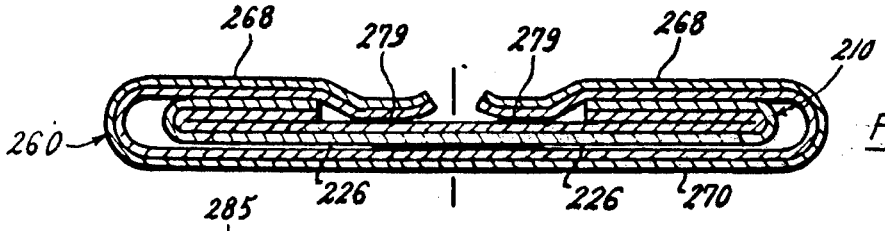
FIG. 8 is a cross sectional view showing a modified pair of inner and outer pouches.
Figure 9:
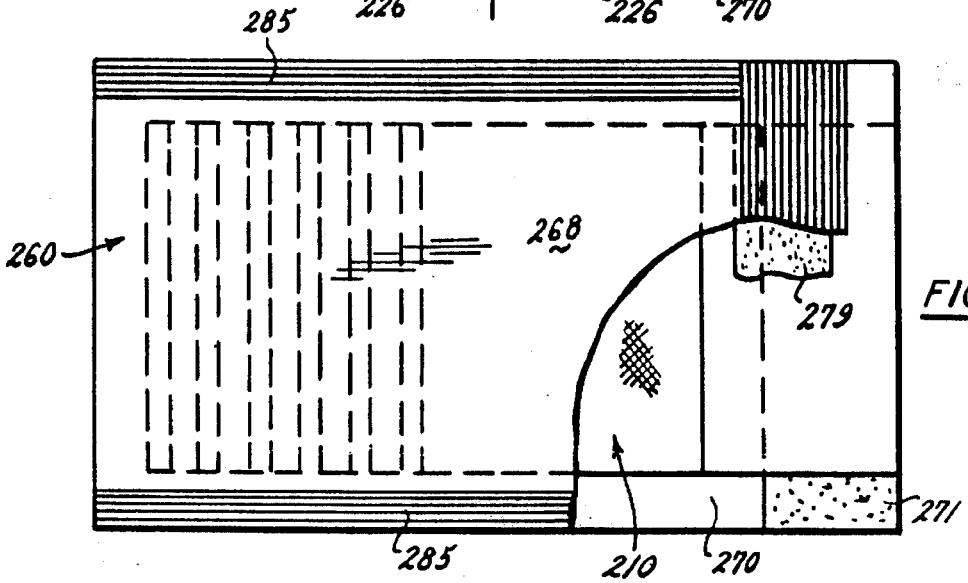
FIG. 9 is a plan view of one of the composite pouches of FIG. 8.

In the embodiment of the invention shown in FIGS. 8 and 9, the outer pouch 260 is substantially identical to that shown in FIGS. 6 and 7. The inner pouch 210 is similar to that shown in FIGS. 6 and 7 except that the short separator sheet is omitted. In this embodiment the inner face of the outer pouch upper panel 268 is transversely heat sealed directly to the inner face of the inner pouch lower panel 226 by peel seal 279. In other respects this embodiment is substantially identical to that shown in FIGS. 6 and 7. The use is demonstrated schematically in FIG. 21.

Figure 10:
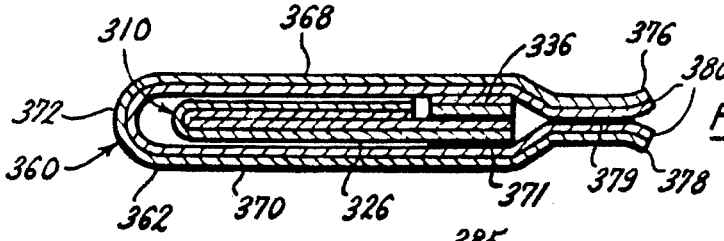
FIG. 10 is a cross sectional view showing a modified single composite pouch.
Figure 11:
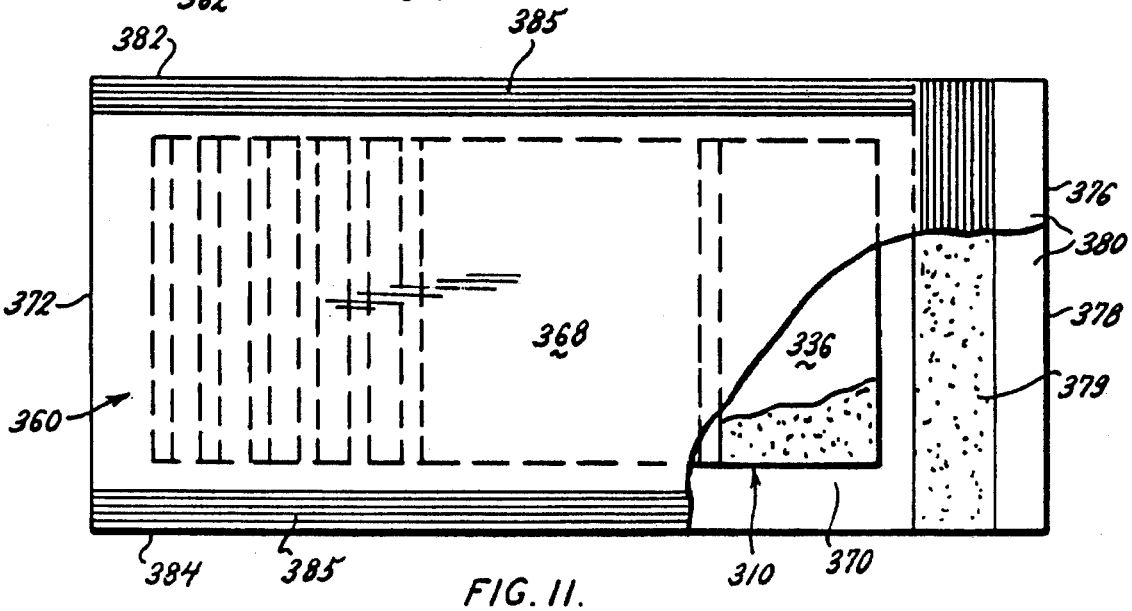
FIG. 11 is a plan view of the composite pouch of FIG. 10.

In the embodiment shown in FIGS. 10 and 11 the inner pouch 310 is substantially similar to inner pouch 110 shown in FIGS. 6 and 7 although the separator sheet 36 can be omitted if desired. However, the outer pouch 360 is substantially different in that it is formed initially as a single pouch rather than being formed initially as a double pouch. The outer pouch 360 is formed from a folded sheet 362 to provide upper and lower panels 368 and 370, respectively defined by a common remote end margin 372 and coterminus proximal end margins 376 and 378. The upper and lower panels 368 and 370 are transversely heat sealed together by peel seal 379 at the proximal end and the seal is preferably stopped short of the margins to form tabs 380. The opposed side margins 382 of the upper panel 368 and the opposed side margins 384 of the lower panel 370 are heat sealed together by peel seals 385 and the outer face of the inner pouch lower panel 326 is transversely heat sealed to the inner face of the outer pouch lower panel 370 by weld seal 371. As will be observed the outer pouch lower panel 370 is longer than the inner pouch lower panel 326 so that the inner pouch 310 is completely enclosed.

Figure 12:
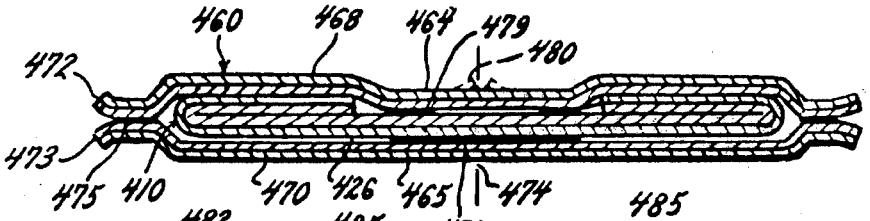
FIG. 12 is a cross sectional view showing another modified pair of composite inner and outer pouches.
Figure 13:
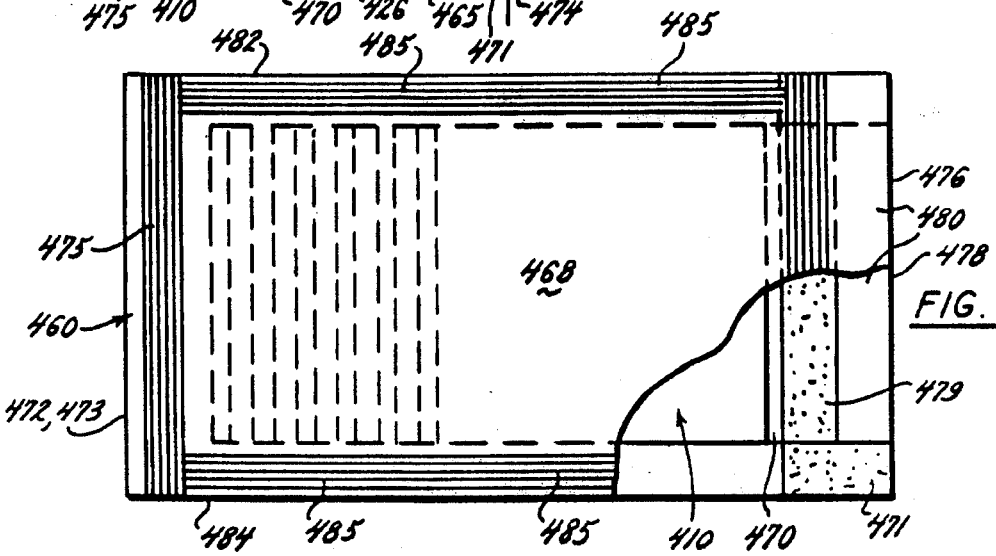
FIG. 13 is a plan view of one of the composite pouches of FIG. 12.

The embodiment shown in FIGS. 12 and 13 provides a different construction for the outer pouch 460 in that the upper and lower panels 468 and 470 are formed from two separate sheets 464 and 465. The inner pouch 410 is substantially similar to the inner pouch 210 shown in FIGS. 8 and 9. The outer pouch upper panel 468 and lower panel 470 each include remote end margins 472 and 473 which are transversely heat sealed together by weld seal 475 to provide a closed remote end. At the proximal end, when separated at the midpoint 474, the panels are defined by coterminus proximal end margins 476 and 478 respectively and the outer pouch panels are transversely heat sealed together adjacent to but short of said margins by peel seal 479 so that a tab 480 is formed. The opposed side margins 482 of the upper panel 468 and the opposed side margins of the lower panel 470 are in register and are heat sealed together by peel seals 485 so that the upper and lower panels can be peeled apart. The outer face of the inner pouch lower panel 426 is transversely heat sealed to the inner face of the outer pouch lower panel 470 by weld seal 471. The use is demonstrated schematically in FIG. 23.

Figure 14:
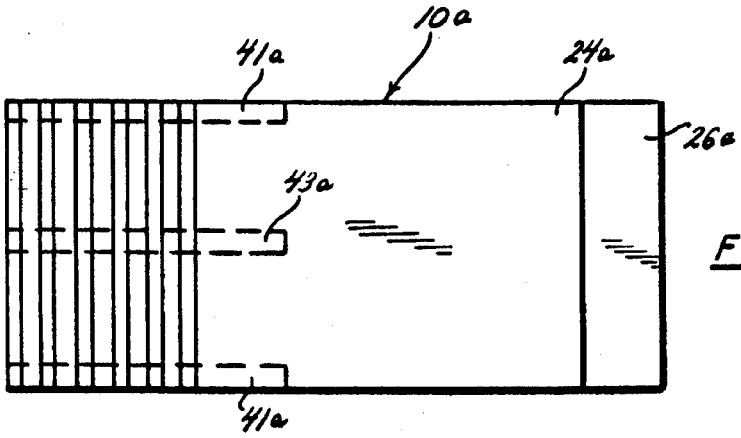
FIG. 14 is a plan view of a single inner pouch having multiple compartments.

The single modified pouch 10*a* shown in FIG. 14 is similar to pouch 10 shown in FIG. 5 except that the separator sheet is omitted. Pouch 10*a* distinguishes from pouch 10 in that a central seal 43*a* is provided between the upper and lower panels 24*a* and 26*a*. This arrangement provides dual chambers each of which receives a finger and enhances control of the pouch under some circumstances.

Figure 15:
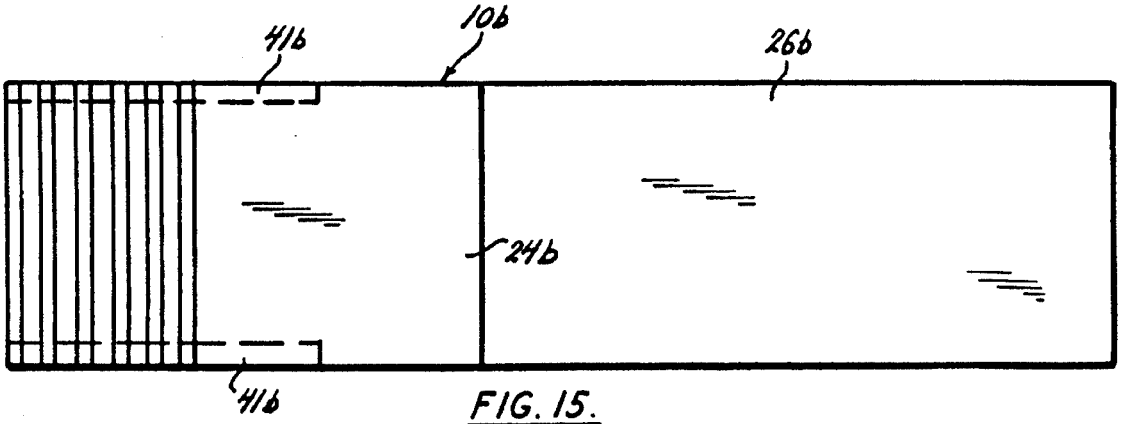
FIG. 15 is a plan view of a single inner pouch having a long lower panel.

The single modified pouch 10*b* shown in FIG. 15 is also similar to that shown in FIG. 5 except that again the separated sheet is omitted but also the lower panel 26*b* is considerably longer than the upper panel 24*b*. This structural arrangement of parts provides a pouch having a flap or handle which can be readily grasped between the uninserted fingers and the palm of the hand. This feature makes it particularly suitable for use in cleaning the teeth of pets.

The method by which the above applicator mitts are constructed will now be described.

Figure 16:
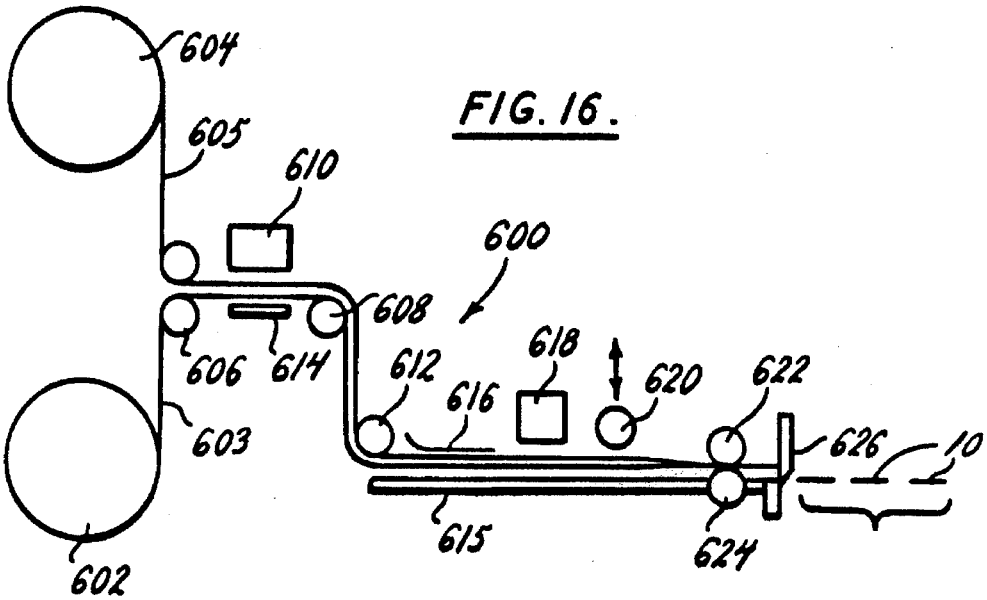
FIG. 16 is a schematic illustrating the method of construction an inner pouch.

The method of forming the inner pouch is best understood by reference to FIG. 16 which illustrates schematically a packaging machine 600, constituting an inner pouch forming apparatus. The packaging machine 600 includes a pair of web dispensing rolls 602 and 604 which dispense a relatively wide web 603 and a relatively narrow web 605 respectively. The webs 603 and 605 pass over idler rollers 606 and 608. At roller 606 the webs are disposed in overlying relation with the narrow web 605 disposed centrally on the wide web 603. Between the rollers 606 and 608 the webs are subjected to heat sealing at heat sealing station 610 disposed above a machine base 614. From roller 608 the heat sealed webs pass under idler roller 612 above a machine base 615 and below a folding station 616 where the web 603 is folded as shown in FIG. 3. From the folding station 616 the composite folded web is passed below a second heat sealing station 618 where the folded sides of the web panels are sealed transversely to form longitudinally spaced seal lines indicated by numeral 41 in FIG. 5. The transversely sealed composite web sections are passed through a slitter station 620 where the composite web is longitudinally slit to separate it into two web portions proceeding in side-by-side relation under the action of pull rollers 622 and 624. The separated webs move under the action of the pull rollers 622 and 624 into the vicinity of cutting station 626 where they are separated into a plurality of separate sections 10 having the configuration shown in FIG. 5.

Figure 17:
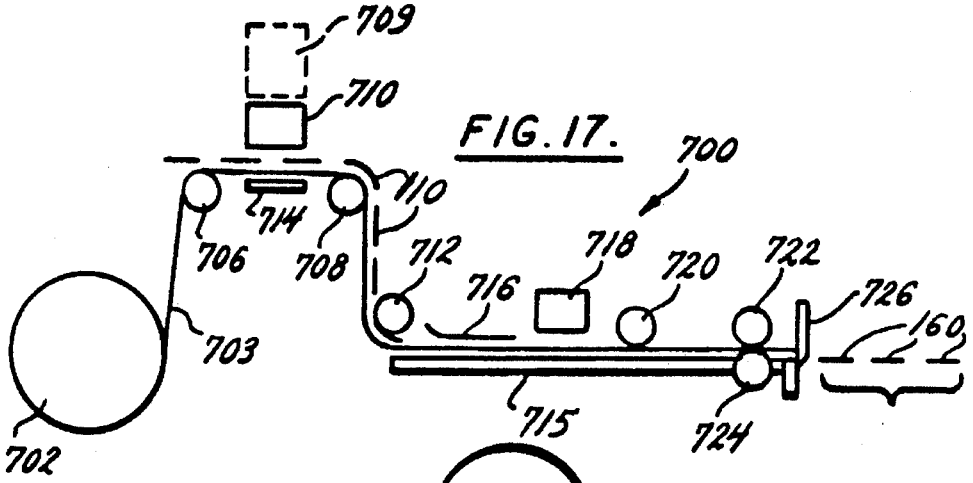
FIG. 17 is a schematic showing the construction of a composite pouch.

The separate sections 10 provide inner pouches which can be packaged individually, or in packs of several pouches, into a conventional plastic envelope 60. Alternatively, the longitudinal slitter 620 can be dispensed with so that the double inner pouches proceed along the conveyor line to a second stage of the packaging machine indicated by numeral 700. This stage of the operation is shown in FIG. 17.

The second stage provides that an underlying web 703 is dispensed from a roll 702 over an idler roll 706. From the idler roller 706 the inner pouches are fed onto the underlying web and at heat sealing station 710 are heat sealed to said web 703. The movement of said pouches can be controlled as by air suction. Alternatively, the separated sections 10 can be collected, loaded into magazine 709 and deposited at predetermined intervals onto said underlying web 703 and heat sealed to said web 703 at heat sealing station 710. In any event, with the inner pouches in place, the web 703 is then passed over idler rollers 708 and 712 and directed toward an enfolding station 716. Following enfoldment the web and the inner pouches are passed through transverse heat sealing station 718 where the margin portions are sealed to the intermediate portion of the inner pouch. From station 718 the combined web is slit longitudinally at slitter station 720 to separate them into two composite longitudinal web portions proceeding in side-by-side relation under the action of pull rollers 722 and 724. As they emerge from the pull rollers 722 and 724 they pass to the final cut-off or transverse slitter station 726 where they are separated into a plurality of combination pouches 160 having the configuration shown in FIGS. 6 and 7.

Figure 18:
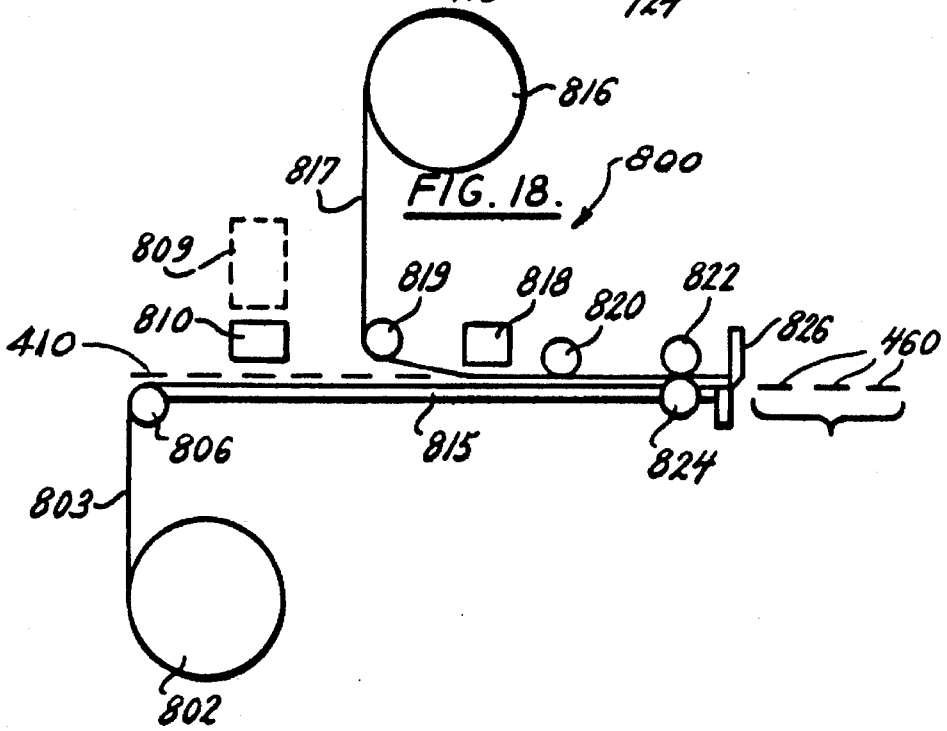
FIG. 18 is a schematic showing the construction of a modified composite pouch.

An alternative method of forming the outer pouch is illustrated in FIG. 18 which illustrates a packaging machine 800. In this method, in lieu of enfolding of the web 703, a web 803 slightly wider than the inner pouch 10, is utilized. An overlying web 817 having the same width as web 803 is dispensed from a roll 816 over an idler roll 819. The inner pouches 410 are sequentially fed onto web 803 and heat sealed into position at heat sealing station 810. Said pouches move forward and are fed between the underlying and overlying webs 803 and 817 respectively. From roller 819 the double inner pouches, now sandwiched between the webs 803 and 815, pass to the heat sealing station 818 for longitudinal sealing along the web margins. The webs 803 and 817 are passed through slitter station 820 where the webs are longitudinally slit together with the spaced inner pouch sections, to separate them into two composite longitudinal web portions proceeding in side-by-side relation under the action of upper and lower pull rollers 822 and 824 following which they are separated at transverse slitter station 826 into a plurality of separate combination pouches 460 having the configuration shown in FIGS. 12 and 13. Alternatively, as discussed above with respect to the second stage of the packaging machine, the separated sections from magazine 810 onto said web 803.

Figure 26A:
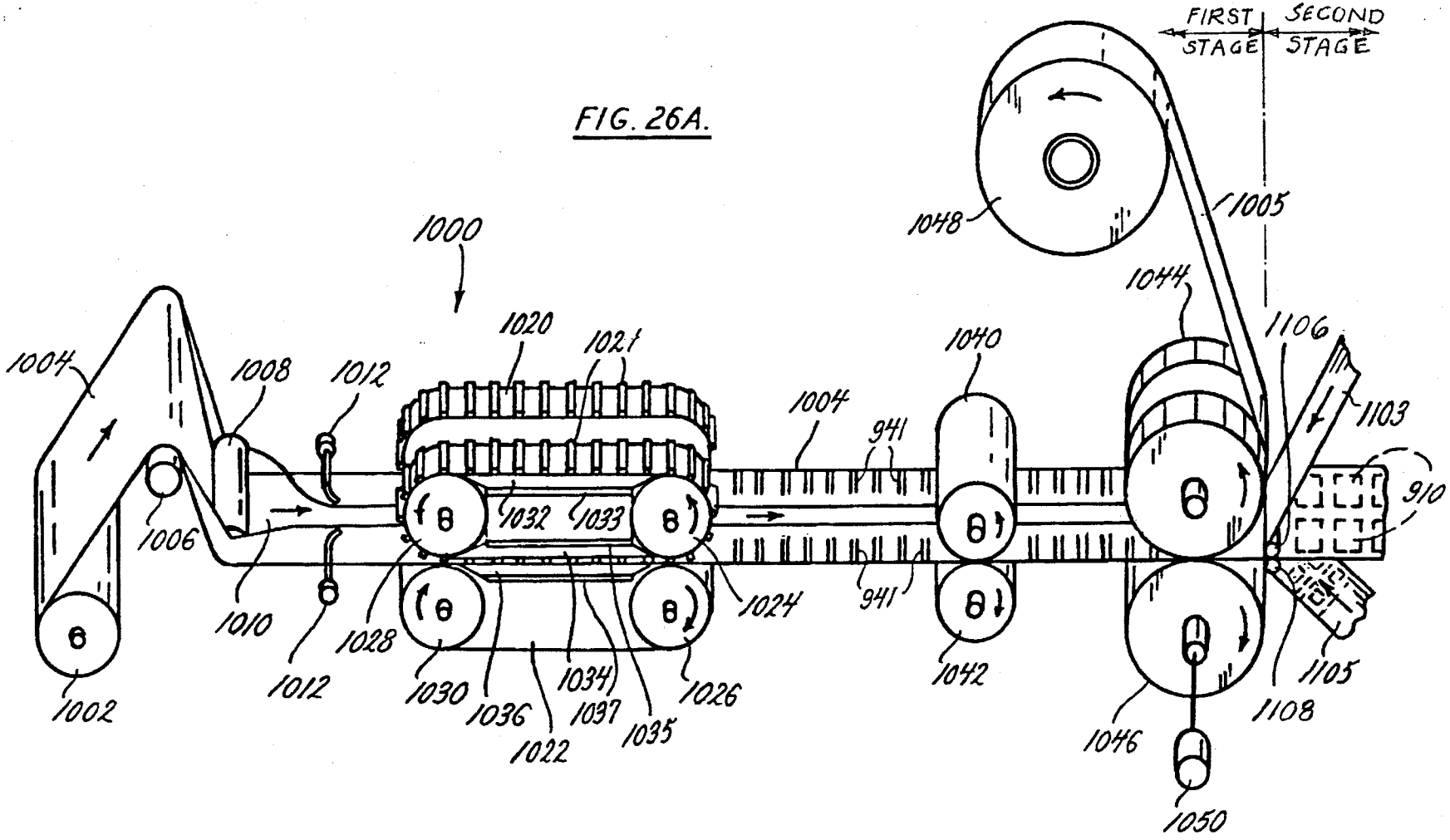
FIG. 26A and FIG. 26B are schematics showing the construction of another modified composite pouch.
Figures 26B, 27, 28, 29:
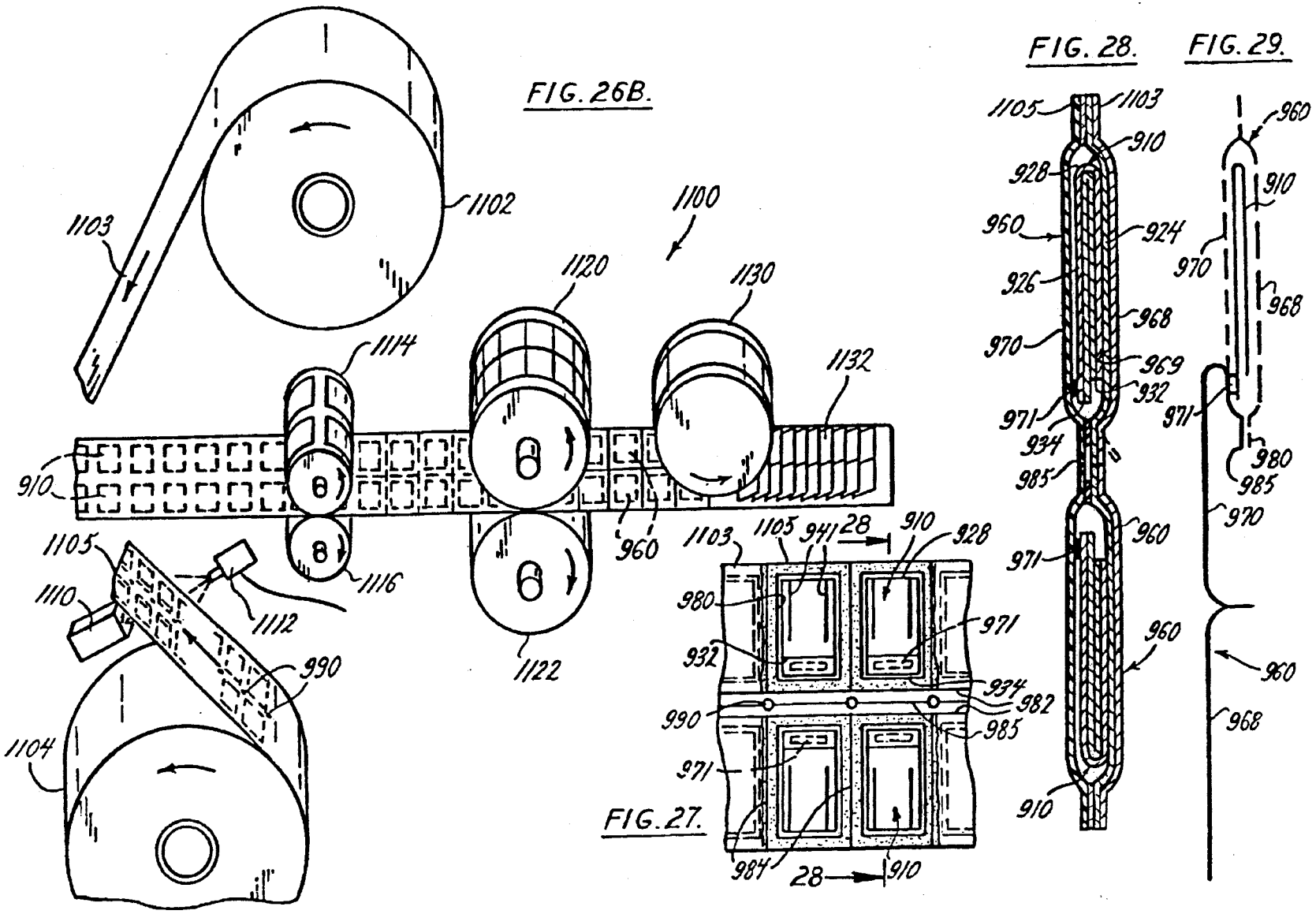
FIG. 27 is an enlarged fragmentary plan view of the modified composite pouches according to FIG. 26A and FIG. 26B.
FIG. 28 is a cross sectional view taken on line 28—28 of FIG. 27.
FIG. 29 is a simplified view showing the use of the composite pouch of FIG. 28.

FIGS. 26A and 26B illustrate a modified method of forming the inner pouch and outer pouch to provide a pouch-within-a pouch construction.

FIG. 26A illustrates schematically a packaging machine first stage, constituting an inner pouch forming apparatus 1000 which folds, seals and cuts the web to form the inner pouches. The apparatus 1000 includes a web dispensing roll 1002 which dispenses a web 1004 consisting of nonwoven fabric with a heat sealing polyethylene backing. The folding operation is accomplished as follows. The web 1004 passes over an idler roller 1006 having edge guides, and a shorter roller 1008, which breaks the web 1004 and starts the web-folding process. The folding process is continued by a guide tongue 1010 and curved guide rods 1012, which cooperate with the guide tongue 1010 to further fold the web 1004 over the tongue 1010.

The inner pouch sealing operation is accomplished by feeding the folded web through a heat sealing apparatus consisting of a pair of top and bottom steel belts 1020 and 1022, respectively, having heated drive pull rollers 1024 and 1026, respectively, at the front end and heated idler rollers 1028 and 1030, respectively, at the rear end. Top belt 1020 includes a plurality of Teflon coated heated seal bars 1021 attached to its outer surface and disposed at equally spaced intervals along its length. Bottom belt 1022 is provided with a Teflon-coated outer surface. Belt 1020 is heated by heating a pair of brass bars 1032 and 1034 provided with strip heaters 1033 and 1035, respectively, in addition to the heated rollers 1024 and 1028, and belt 1022 is similarly heated by a brass bar 1036 provided with strip heater 1037, in addition to the heated rollers 1026 and 1030. The web 1004 emerges from the sealing operation with the folded portions sealed in sets at equally spaced intervals as shown by numerals 941.

The inner pouch cutting operation is accomplished by feeding the selectively sealed web 1004 through top and bottom pull rollers 1040 and 1042 and through a cutter die assembly. The cutter die assembly includes a pull die roller 1044 with top die sheeting blades configurated to provide an inner pouch cut-out and cut off and a slitter blade which removes the central strip portion 1005 of the folded web 1004 and a pull anvil roller 1046 with bottom plain die configurated to provide a cooperating inner pouch cut-out and cut off which cut the remaining opposed folded portions of the web 1004 transversely adjacent the seal lines to form individual inner pouches 910. The central strip portion of the web 1004 is wound onto a trim rewind roller 1048. The bottom pull anvil roller 1046 includes a connected shaft encoder 1050 which senses or monitors the anvil/die position and the separated inner pouch positioning, prior to delivery between the top and bottom idler rollers 1106 and 1108 associated with the second stage 1100 which forms an outer pouch disposed about the inner pouches, as will now be described.

FIG. 26B illustrates schematically a packaging machine second stage 1100, constituting an outer pouch forming apparatus, which completes the formation of the pouch-within-a-pouch applicator mitt by encapsulating individual inner pouches 910 within individual outer pouches 960. The second stage 1100 forms the outer pouch about the inner pouch while keeping the preprinted graphics of the outer pouch in register.

The second stage includes top and bottom web rolls 1102 and 1104 carrying web 1103 and 1105 respectively. The top web 1103, which becomes the back panel of the package, is preferably of polypropylene, polyester, foil or similar barrier type film having a coating of cold seal completely covering side A. The bottom web, 1105, which becomes the front panel of the package, is usually of the same material having a patterned coating of cold seal partially covering side A. The bottom web 1105 is the web from which the outer pouch bottom covers are made and carries a printed image and registered eye marks 990. The top web 1103 and the bottom web 1005 come together around associated end rollers 1106 and 1108, respectively, which receive the inner pouches 910.

A hot melt adhesive applicator 1110 is stationed adjacent one side of the web 1005, which applies the adhesive bars 971 to a non-cold sealed portion of web 1105 bonding the inner pouches 910 to the outer pouches 960. A cooperating registration sensor 1112 is stationed adjacent the other side of the web 1105 to detect the electric eye marks 990 on said web. This arrangement provides that the inner pouches entering between the sandwiching webs 1103 and 1105 are firmly affixed to the bottom web 1105.

The two stages 1000 and 1100 of the packaging machine are tied together by a registration system which treats one part (the outer pouch 960) as a master and makes corrections on the position of the other part (the inner pouch 910) as a slave based on feedback from the encoder 1050 of the first stage 1000 and the electronic sensor 1112 on the second stage 1100. Such registration system might, for example, be a servo drive (not shown), an independent motor (not shown) or a differential gear box (not shown) off a common drive line (not shown). The encoder 1050 mounted on the bottom anvil roller 1046 provides both speed and position information to the registration system and with this information the registration system "knows" the position of the inner pouches. Sensor 1112 provides the registration system with information as to the position of print on the bottom web 1105. The registration system controls the speed of the first stage in order to maintain the proper relationship between the inner pouch 910 and the outer pouch 960.

Sealing pressure is applied to the webs 1103 and 1105 by top and bottom pull rollers 1114 and 1116, roller 1114 being provided with a suitable circumferential and longitudinal die pressure configuration, and roller 1116 being plain, to firmly attach the opposing cold seal portions together about the inner pouches 910, it being understood that cold seal used is intended to seal only to a like cold seal surface in peel seal relation. The webs 1103 and 1105 with the inner pouches affixed to bottom web 1105 are next fed between a pull die roller 1120 having suitable slitting and sheeting blades and pull anvil roller 1122 having a cooperating plain surface. Rollers 1120 and 1122 may also feed back information to the encoder 1050. Finally, the sandwiching webs 1103 and 1105, now sealed and cut to form the completed pouch-within-a pouch construction, are passed by a stacker conveyor 1130 to a collection station 1132.

The resulting pouch-within-a-pouch formed by the method described with reference to FIGS. 26A and 26B is similar to that illustrated in FIG. 12, in that it includes separate outer pouch overlying panels of the same size, and is best understood by reference to FIGS. 27–29. When formed as described above, the inner pouches 910 each include an upper panel 924 and a lower panel 926 defined by common remote end margins 928 and spaced end margins 932 and 934 as shown in FIG. 27 and FIG. 28. The side margins of the upper panel 924 and the side margins of the lower panel 926 are heat sealed together for a substantial portion of their weld seals 941.

The outer pouches 960 each include an upper panel 968 and a lower panel 970. The upper panel 968 is preferably formed from polypropylene, polyester, foil or like having preformed cold seal coating covering the entire inner side A. The lower panel 970 is also formed from the same material having cold seal coating but covering only a selected portion of the inner side A to define framed uncoated rectangular pockets 980 and a central uncoated strip portion defined by margins 982. The uncoated pockets 980 each receive a bar 971 of machine applied adhesive from the adhesive applicator and the inner pouches 910 are located in the pockets such that the bottom panel 934 of said inner pouch is firmly and substantially permanently attached to the bottom panel 970 of the outer pouch 960. The bottom web 1105 carries registered eye marks 990 at intervals which are detected by the registration sensor 1112, as described above, to ensure accurate location of the inner pouches 910.

The arrangement described above provides that when the pouch-within-a-pouch packages are separated along lateral lines 984 and longitudinal line 985 there is an uncoated portion of lower outer pouch panels 970 adjacent longitudinal line 985 which provides a finger tab 980 facilitating peel seal removal of the upper panel 968 from the lower panel 970.

It will be understood that although hot melt liquid is used in the preferred embodiment to attach the inner pouch applicator mitt to the outer mitt cold adhesive providing substantially the same permanent attachment of the two pouches could be used. Similarly, although cold seal adhesive is used in the preferred embodiment to attach the strips or panels of the outer pouch to each other, heat sealable patterned EVA film can be used for the same purpose. However, cold seal adhesive can be sealed much more rapidly than hot seal since no dwell time is required with cold seal manufacturing speeds of up and beyond 1,000 units per min. are possible.

In view of the above it will be seen that various aspects and features of the invention are achieved and other advantageous results attained. While a preferred embodiment of the invention has been shown and described, it will be clear to those skilled in the art that changes and modifications may be made therein without departing from the invention in its broader aspects.

I claim as my invention:

1. A method of constructing a packaged applicator mitt, comprising the steps of:

a) forming a mitt from a folded laminate of beat sealable material and a material suitable for use as an applicator, the mitt having an open end, b) placing the mitt between first and second strips of sealable material sufficiently large to enclose the mitt, c) attaching the mitt substantially permanently to only one of said strips in the area of the open end, and d) sealing the strips together in spaced relation from the mitt to seal in the mitt and form an outer pouch so that the outer pouch can be opened and removed from the mitt with said mitt remaining attached to said one strip.

2. A method of constructing a packaged applicator mitt as defined in claim 1, in which:

e) said mitt is attached to said one strip by permanent adhesive.

3. A method of constructing a packaged applicator mitt as defined in claim 1, in which:

e) said first and second strips each include plastic film having an inner coating of cold seal adhesive.

4. A method of constructing a packaged applicator mitt as defined in claim 3, in which:

f) said first and second strips are selectively coated with said cold seal adhesive to permit said mitt to be attached to said one strip in an area uncoated by said cold seal.

5. A method of constructing a packaged applicator mitt as defined in claim 3, in which:

f) said first strip is substantially completely coated with said cold seal adhesive and said second strip is pattern-coated with said cold seal adhesive to define an area uncoated by said cold seal receiving said mitt and permitting said mitt to be attached to said one strip.

6. A method of constructing a packaged applicator mitt, comprising the steps of:

a) dispensing a web of material having first opposed margins defining opposed side portions, said web having a longitudinal axis disposed intermediate said margins, b) folding said side portions inwardly toward the longitudinal axis to define folded margins, c) sealing said web transversely at spaced intervals along the length thereof to form a plurality of pairs of open ended pouches, d) slitting said web longitudinally into opposed web portions, e) cutting said web portions transversely at spaced intervals along the length thereof to form a plurality of separated pairs of open-ended pouches disposed in side by side relation, f) dispensing first and second webs of material having first opposed margins defining opposed side portions, said web having a longitudinal axis disposed intermediate said margins, g) feeding said separated pairs of open-ended pouches between said first-and second webs at spaced intervals whereby said open-ended pouches are sandwiched therebetween, h) sealing said open-ended pouches to one only of said sandwiching webs in substantially permanent relation, i) sealing said first and second webs together about said open-ended pouches to provide outer pouches encapsulating said open-ended pouches, j) slitting said encapsulating pouch along said longitudinal axis of said first and second webs, and k) cutting said first and second webs transversely at spaced intervals along the length thereof said open-ended pouches to form separate composite pouches.

7. A method of constructing a packaged applicator mitt as defined in claim 6, in which:

l) said open-ended pouches are attached to said one web by permanent adhesive applied to said one web.

8. A method of constructing a packaged applicator mitt as defined in claim 6, in which:

l) said open-ended pouch transverse seals are substantially permanent heat seals.

9. A method of constructing a packaged applicator mitt as defined in claim 6, in which:

said first sandwiching web is substantially completely pre-coated with cold seal adhesive, and m) Said second sandwiching web is pattern pre-coated with cold seal adhesive to define web areas uncoated by cold seal selectively receiving said open-ended pouches, said uncoated areas having a permanent adhesive applied to attach said open-ended pouch.

10. A method of constructing a packaged applicator mitt as defined in claim 9, in which:

n) said second sandwiching web patterned cold seal adhesive defines frame areas peel seal attachable to said cold seal adhesive of said first cold seal adhesive.

11. A method of constructing a packaged applicator mitt as defined in claim 10, in which:

o) said second sandwiching web patterned cold seal adhesive defines an uncoated area adjacent said open-pouch open end providing a tab for facilitating removal of said outer pouch.

* * * * *